United States Patent [19]

Uchihara

[11] Patent Number: 4,803,833

[45] Date of Patent: Feb. 14, 1989

[54] PNEUMATIC YARN SPLICING APPARATUS

[75] Inventor: Kiyoyuki Uchihara, Takatsuki, Japan

[73] Assignee: Murata Kikai Kabushiki Kaisha, Kyoto, Japan

[21] Appl. No.: 166,408

[22] Filed: Mar. 10, 1988

[30] Foreign Application Priority Data

Mar. 16, 1987 [JP] Japan ..... 62-60299

[51] Int. Cl.[4] ..... D01H 15/00

[52] U.S. Cl. ..... 57/22

[58] Field of Search ..... 57/22, 261, 263

[56] References Cited

U.S. PATENT DOCUMENTS 4,397,137 8/1983 Davies et al. ..... 57/22
4,505,098 3/1985 Baba ..... 57/22
4,565,059 1/1986 Mima ..... 57/22
4,671,053 6/1987 Mima ..... 57/22
4,693,067 9/1987 Locatelli ..... 57/22

*Primary Examiner*—Donald Watkins
*Attorney, Agent, or Firm*—Spensley Horn Jubas & Lubitz

[57] ABSTRACT

A pneumatic yarn splicing apparatus including a yarn splicing member having a cylindrical yarn splicing hole, air nozzles opened in the splicing hole, and a yarn inserting slit wherein the air nozzles are opened non-tangentially on the inner periphery of the yarn splicing hole to spurt compressed air toward yarn ends and have a shape of an elongated slot extending in the axial direction of the yarn splicing hole.

6 Claims, 3 Drawing Sheets

PNEUMATIC YARN SPLICING APPARATUS

FIELD OF THE INVENTION

This invention relates to a pneumatic yarn splicing apparatus.

RELATED ART STATEMENT

It has been known to splice ends of two separate yarns by applying compressed air on overlapped yarn end portions. More specifically, the two yarn ends are inserted and set in a yarn splicing hole such that the two yarn ends are directed in the opposite directions, and compressed air is jetted into the yarn splicing hole thereby vibrating and rotating the overlapped yarn ends to splice the yarn ends by the intertwining, combining and twisting actions on the yarn fibers, for example, as disclosed in Japanese Patent Publication No. 61-16711.

The above-described apparatus, however, has a problem in the strength of spliced portions. Especially in case of yarns of the so-called "long fibers" like spun yarns of chemical synthetic fibers or wool where the individual fibers are longer as compared with short cotton fibers or the like, it is difficult to secure a sufficient yarn strength simply by intertwisting since the individual fibers which constitute the yarns have smooth surfaces with a low frictional resistance.

In addition, when splicing yarns mainly by the intertwisting action, there arises a problem in case of the so-called soft twist yarns like low count yarns with a small number of twists, i.e., a problem of untwisting yarn breakages which occurs to one of the upper and lower yarns as it is turned by swirling air streams, rendering the yarn splicing operation difficult.

OBJECT AND SUMMARY OF THE INVENTION

It is an object of the present invention to provide a yarn splicing apparatus which can guarantee a sufficient splicing strength especially for long fiber yarns ranging from low to high count yarns.

In accordance with the present invention, air injection nozzles are formed on the opposite sides of a yarn inserting slit of a yarn splicing hole and opened non-tangentially on the inner periphery of the yarn splicing hole to spurt compressed air toward the yarn ends which are positioned on a side remote from the slit, the air injection nozzles each having a shape of an elongated slot extending in the axial direction of the yarn splicing hole.

The compressed air which is spurted from the wall surfaces on the opposite sides of the slit is impinged on the overlapped yarn ends such that the directly impinging air streams act over a wide width of the overlapped yarn portions to intertwine the fibers of the yarn ends in an extremely secure manner, intermixing the individual fibers to unite the yarn ends strongly without imparting rotational motions thereto.

BRIEF DESCRIPTION OF THE DRAWINGS

FIGS. 1 to 4 illustrate an embodiment of the yarn splicing nozzle unit according to the invention, of which FIG. 1 is a sectioned plan view, FIG. 2 is a front view, FIG. 3 is a left-hand side view and FIG. 4 is a right-hand side view of the unit;

DETAILED DESCRIPTION OF PREFERRED EMBODIMENTS

Figure 1:
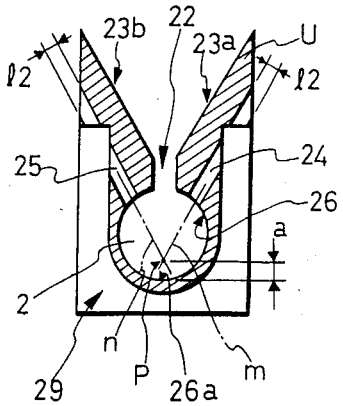

Hereafter, the apparatus of the invention is described more particularly by way of the embodiments shown in the drawings.

Figure 6:
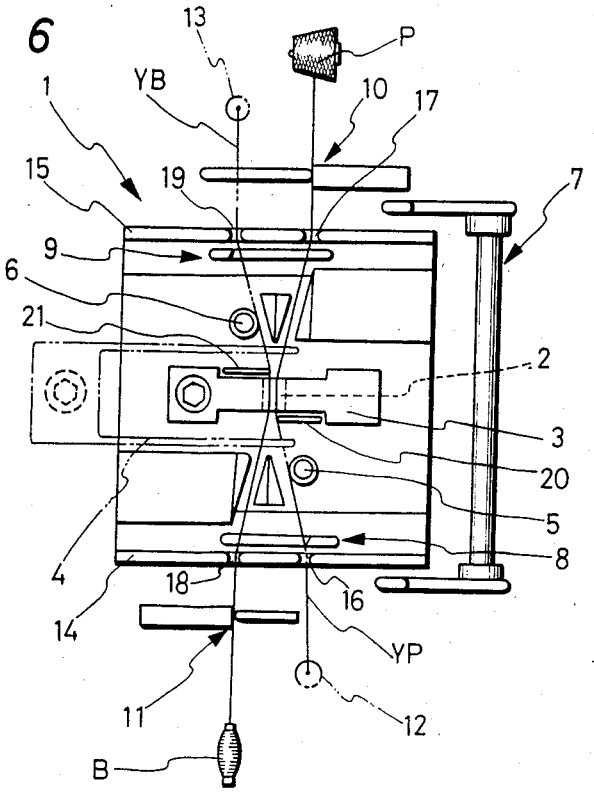
FIG. 6 is a schematic front view of an exemplary embodiment of the pneumatic yarn splicing apparatus.
Figure 7:
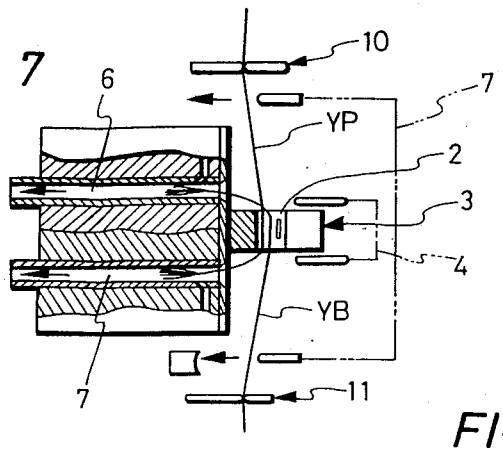
FIG. 7 is a partly sectioned side view of the apparatus.

Referring to FIGS. 6 and 7, there is illustrated the general configuration of a yarn splicing apparatus according to the invention. The yarn splicing apparatus 1 includes: a yarn splicing member 3 which is formed with a yarn slicing hole 2; a yarn pressing device 4; yarn end untwisting nozzles 5 and 6; yarn positioning lever 7; yarn cutters 8 and 9; and yarn clamps 10 and 11.

The yarn splicing operation is performed in the following order. Firstly, when the yarn splicing apparatus is provided on a known automatic winder, a yarn YP on the side of a package P is attracted to and held in a suction mouth 12 of a known construction and guided to the front side of the yarn splicing apparatus by a rotational movement of the suction mouth 12, clamping part of the yarn YP by the yarn clamp 10. On the other hand, a yarn YB on the side of a fine spinning bobbin B is guided by a rotatable relay pipe 13 and clampled by the other clamp 11. Thereafter, by rotation of the yarn positioning lever 7, one YP of the yarns YP and YB is urged into guide grooves 16 and 17 of guide plates 14 and 15 and inserted in the yarn splicing hole 2, while the other yarn YB is urged into guide grooves 18 and 19 and inserted into the yarn splicing hole 2, positioning the yarn ends in the state as shown particularly in FIG. 6. Succeedingly, the yarn cutters 8 and 9 are actuated to cut the yarns YP and YB in a position at a predetermined distance from the clamped position, and the trimmed yarn ends are suctioned into yarn end untwisting nozzles 5 and 6 to untwist them into a state suitable for yarn splicing by the action of compressed air streams which are injected into the nozzles 5 and 6. Namely, the yarns are freed of the twists to have the fibers in a parallel form like the tip of a writing brush. At this time, the yarn positioning lever 7 assumes a retracted position away from the yarns, and the yarn ends are suctioned deep into the untwisting nozzles 5 and 6 as shown particularly in FIG. 7.

After the above-described untwisting operation, the yarn positioning lever 7 is largely turned toward the yarns again, thereby drawing the yarn ends out of the untwisting nozzles 5 and 6 and overlapping and setting the untwisted tip end portions of the yarns in the yarn splicing hole 2 in co-operation with the yarn holder 4.

Then, the yarns are spliced by the action of the compressed air streams which are spurted into the yarn splicing hole 2 as described hereinbefore.

Indicated at 20 and 21 in FIG. 6 are control plates which are securely fixed to the yarn splicing member 3 to cover part of the openings at the opposite ends of the yarn splicing hole 2 for restricting the yarn positions and controlling the air streams which flow out through the opposite open ends of the yarn splicing hole 2.

Now, a yarn splicing nozzle unit U which is provided on the yarn splicing member 3 is described with reference to FIGS. 1 to 4.

The yarn splicing nozzle unit U is provided with a cylindrical yarn splicing hole 2, a yarn inserting slit 22 extending radially outward of the yarn splicing hole 2, and inclined surfaces 23*a* and 23*b* forming yarn guide surfaces contiguously to the slit 22. The slit 22 is formed axially over the entire length of the yarn splicing hole 2.

Compressed air spurting nozzles 24 and 25 are opened in the wall surfaces on the inner periphery 26 of the yarn splicing hole 2 on the opposite sides of the slit 22 nontangentially to the inner peripheral surface 26 and with an inclination such that the intersecting point P of extension lines m and n of center lines of the respective air injecting nozzles 24 and 25 is spaced by a predetermined distance from an inner peripheral wall surface 26*a* on the side remote from the slit 22. Namely, the above-mentioned intersecting point P is desired to be located at least in the space of the yarn splicing hole 2. Further, in this embodiment the angle of inclination of the air injecting nozzles is determined such that the nozzles are located in symmetrical positions on the opposite sides of the slit 22 and the intersecting point P is located on the center line of the slit 22. However, of course the air injection nozzles 24 and 25 may have different inclination angles in some cases.

The air injection nozzles 24 and 25 are in the form of a flat slot of rectangular or elliptic shape in section in a plane perpendicular to the direction of air flow, at any position along the air passages of the nozzles 24 and 25.

Figure 2:
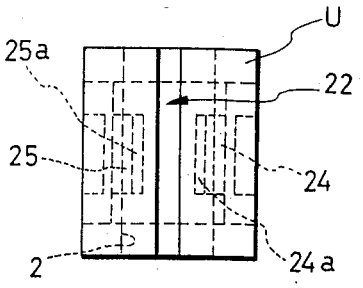
Figure 3:
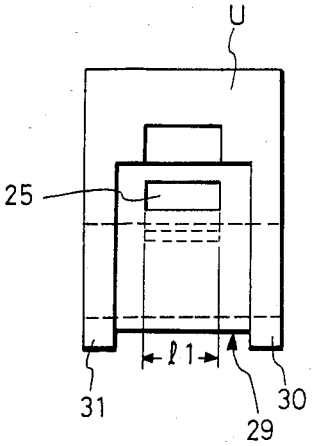
Figure 4:
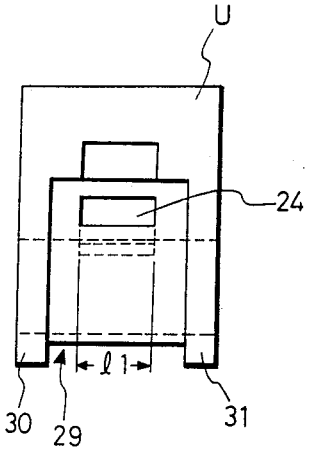

More specifically, as shown in FIGS. 1 to 4, they are in the form of a non-circular flat slot dimensioned such that the length l1 in the axial direction of the yarn splicing hole 2 and the width l2 of the nozzles 24 and 25 are in the relationship of $l1>l2$. The relationship between these dimensions l1 and l2 may be altered depending upon the kind of the yarns and the size of the nozzle unit. Further, as shown in FIG. 2, the openings 24*a* and 24*b* are formed in a median portion in the axial direction of the yarn splicing hole 2, without deviation from each other in the axial direction. Functions substantially same as this embodiment are available even in a case where there is a slight difference in the length l1 between the nozzles 24 and 25 or where the nozzles are formed in the same dimensions but deviated slightly from each other in the axial direction.

A compressed air passage 29 is formed on the outer side of the yarn splicing hole 2 by flanges 30 and 31 and wall surfaces (indicated at 32 in FIG. 5) which closingly circumvent the passage when the unit is mounted on the yarn splicing member, the air passage 29 being connected to a passage 33 which is formed in the yarn splicing member 3 and communicated with a pipe leading to a compressed air source.

Figure 5:
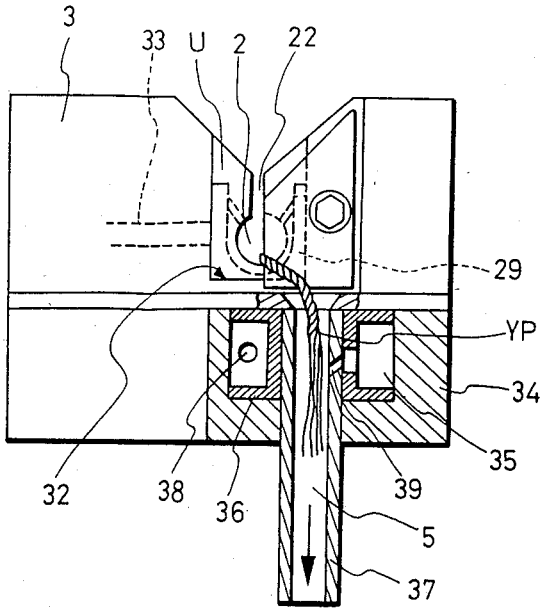
FIG. 5 is a partially sectioned plan view showing the relationship between the yarn splicing nozzle unit and yarn end untwisting nozzles.

Indicated at 5 in FIG. 5 is a yarn end untwisting nozzle including an untwisting nozzle pipe 37 which is slidably and rotatably fitted in a center bore of a bushing 36 which is in turn fitted in a cylindrical recess 35 of a block 34, spurting compressed air into the pipe 37 from an air injection hole 39 which is slantingly formed in the pipe, for untwisting the yarn end YP. The untwisting nozzles 5 and 6 of FIG. 6 have the same construction.

The above-described apparatus performs the yarn splicing operation in the manner as follows.

Figure 9:
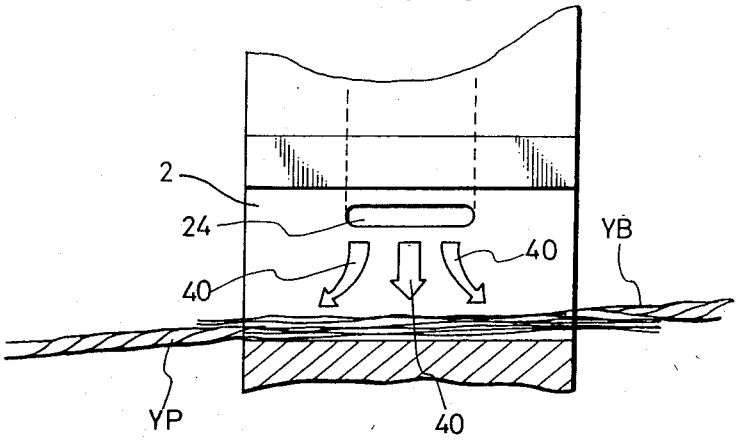
FIG. 9 is a sectional view taken on line X—X of FIG. 8.
Figure 8:
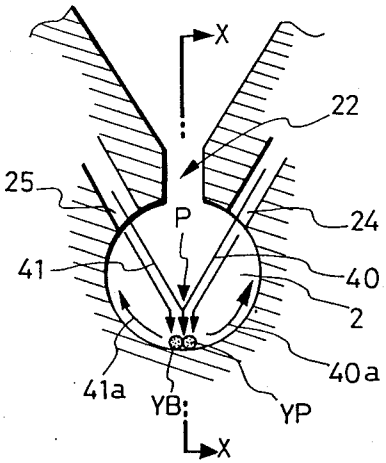
FIG. 8 is a diagrammatic illustration showing behaviors of jet air strems within a yarn splicing hole.

The yarn ends YP and YB which have been untwisted by the air streams from the untwisting nozzles 5 and 6 are drawn out therefrom by the action of the yarn positioning lever 7 and overlapped within the yarn splicing hole 2, holding the overlapped yarn ends in a predetermined position (FIG. 8) by the yarn holder 4 and control plates 20 and 21. In the next place, compressed air is spurted from the first and second air nozzles 24 and 25 in the directions of arrows 40 and 41 toward the overlapped yarn ends which are held in position as in FIGS. 8 and 9. Namely, the spurted air streams are collided in the vicinity of the afore-mentioned intersecting point P, forming integrated air streams which act on and splice the yarn ends by intermixing and combining the individual fibers in an extremely positive manner. The spurted air streams are bombarded on the wall surfaces on the side away from the slit 22, and tend to flow along the inner peripheral wall, forming swirling streams of opposite directions as indicated by arrows 40*a* and 41*a*. However, the air streams along the inner peripheral wall are blocked by the air jets from the injection nozzles 24 and 25, exhibiting random fluid behaviors as a whole. As a consequence, the fibers of the yarn ends YP and YB undergo intermixing, intertwining and, in some cases, twisting actions of the air streams, to form a randomly intertwined splice of which is free of twists in a particular direction. Especially in case of long fiber, a strong splice is formed by frictional, torsional and enveloping intertwinement of the individual fiber filaments. The untwisted end portions are neatly retained in the spliced joint without forming horny protrusions.

Following Tables 1 to 3 show by way of examples the results of yarn splicing operations by the apparatus of the invention and the afore-mentioned conventional apparatus, using yarns of long fibers such as nylon, wool and rayon under the same conditions including the spurting compressed air pressure.

TABLE (1)

| | (A) Nylon Nm 4 | | |
|---|---|---|---|
| | Parent Yarns (Min) | Spliced Joint (Min) | Retention Rate |
| Invention | 4488 (3353) | 4110 (2866) | 91.6% |
| Convent'l | 4707 (2664) | 2789 (857) | 59.2% |

TABLE (2)

| | (B) Wool Nm 2.7 | | |
|---|---|---|---|
| | Parent Yarns (Min) | Spliced Joint (Min) | Retention Rate |
| Invention | 5478 (4010) | 5117 (3774) | 93.4% |
| Convent'l | 5356 (4147) | 3872 (565) | 72.3% |

TABLE (3)

| | (C) Rayon Nm 4 | | |
|---|---|---|---|
| | Parent Yarns (Min) | Spliced Joint (Min) | Retention Rate |
| Invention | 2679 (2274) | 2495 (1907) | 93.1% |
| Convent'l | 2628 (2223) | 2072 (1052) | 78.8% |

Each of the tables 1 to 3 shows results of measurement of yarn strength. The unit of the value is gram (gr.) and the values are obtained by measuring the value of yarn strength when a sample of yarn of 50 cm is processed to a measuring machine for a tensil strength and the sample yarn is broken. The values shown in the tables are mean yarn strength while the values shown in ( ) are the minimum yarn strength obtained in the measuring.

It will be apparent from the foregoing description that, according to the present invention, the apparatus of the invention can improve the strength of yarn spliced joint to a considerable degree as compared with conventional counterparts, and particularly has conspicuous effects as a yarn splicing apparatus for long fibers.

What is claimed is:

1. A pneumatic yarn splicing apparatus characterized in that air nozzles are opened non-tangentially on the inner periphery of a yarn splicing hole on the opposite sides of a yarn inserting slit of the yarn splicing hole to spurt compressed air toward yarn ends positioned on a side away from said slit, said air nozzles each having a shape of an elongated slot extending in the axial direction of said yarn splicing hole.

2. The pneumatic yarn splicing apparatus as claimed in claim 1, wherein said air nozzles are opened on the inner periphery of the yarn splicing hole such that the intersecting point of extension lines of center lines of the respective air nozzles is spaced by a predetermined distance from an inner peripheral wall surface on the side remote from the slit and is located in the space of the yarn splicing hole.

3. The pneumatic yarn splicing apparatus as claimed in claim 2, wherein the angle of inclination of the air nozzles is determined such that the air nozzles are located in symmetrical positions on the opposite sides of the slit and the intersecting point is located on the center line of the slit.

4. The pneumatic yarn splicing apparatus as claimed in claim 1, wherein the air nozzles are in the form of a flat slot of rectangular shape in section in a plane perpendicular to the direction of air flow, at any position along the air passage of the air nozzles.

5. The pneumatic yarn splicing apparatus as claimed in claim 1, wherein the air nozzles are in the form of a flat slot of elliptic shape in section in a plane perpendicular to the direction of air flow, at any position along the air passage of the air nozzles.

6. A pneumatic yarn splicing apparatus including a yarn splicing member, a yarn pressing device, yarn end untwisting nozzles, yarn positioning levers, yarn cutters, and yarn clamps, said yarn splicing member being provided with a cylindrical yarn splicing hole, air nozzles opened on the inner periphery of the yarn splicing hole, a yarn inserting slit extending radially outward of the yarn splicing hole and formed axially over the entire length of the yarn splicing hole, and inclined surfaces forming yarn guide surfaces contiguously to the slit, characterized in that:

said air nozzles are opened non-tangentially on the inner periphery of a yarn splicing hole on the opposite sides of the yarn inserting slit to spurt compressed air toward yarn ends positioned on a side away from the slit, said air nozzles each having a shape of an elongated slot extending in the axial direction of the yarn splicing hole.

* * * * *